United States Patent [19]

Dugan

[11] Patent Number: 4,777,677

[45] **Date of Patent: * Oct. 18, 1988**

[54] MATTRESS PAD AND FITTED BED SHEET FOR FOLDABLE SOFA BED MATTRESSES

[75] Inventor: Jeffrey S. Dugan, Matthews, N.C.

[73] Assignee: Springs Industries, Inc., Fort Mill, S.C.

[ * ] Notice: The portion of the term of this patent subsequent to Jul. 28, 2004 has been disclaimed.

[21] Appl. No.: 894,118

[22] Filed: Aug. 7, 1986

Related U.S. Application Data

[63] Continuation-in-part of Ser. No. 805,319, Dec. 4, 1985, Pat. No. 4,682,379.

[51] Int. Cl.[4] ..... A47C 17/04; A47G 9/04

[52] U.S. Cl. ..... 5/13; 5/497; 5/500; 5/502

[58] Field of Search ..... 5/13, 495–497, 5/499–502

[56] References Cited

U.S. PATENT DOCUMENTS

| | | | |
|---|---|---|---|
| 1,334,901 | 3/1920 | Higdon . | |
| 1,867,425 | 11/1930 | Swetzel . | |
| 2,162,755 | 6/1939 | Shauer | 5/497 |
| 2,319,150 | 5/1943 | Mink | 5/499 |
| 2,516,363 | 7/1950 | Block et al. . | |
| 2,677,137 | 6/1949 | Bergin . | |
| 2,856,615 | 7/1957 | Cirocco . | |
| 2,924,833 | 2/1960 | Klogether . | |
| 2,942,280 | 6/1960 | May, Jr. . | |
| 2,963,715 | 12/1960 | Young . | |
| 3,013,283 | 8/1960 | Steffinich . | |
| 4,192,032 | 3/1980 | Geraci | 5/499 |
| 4,301,559 | 11/1981 | Geenberghe | 5/13 |
| 4,301,561 | 11/1981 | McLeod . | |
| 4,317,244 | 3/1982 | Balfour-Richie . | |
| 4,338,693 | 7/1982 | Vitale | 5/500 |
| 4,422,195 | 12/1903 | Russo et al. | 5/497 |
| 4,651,370 | 3/1987 | Vitale | 5/500 |

*Primary Examiner*—Alexander Grosz
*Assistant Examiner*—Michael F. Trettel
*Attorney, Agent, or Firm*—Thomas & Kennedy

[57] ABSTRACT

The mattress pad and fitted bed sheet (31) are formed by placing equal lengths of mattress pad material (58) and bed sheet material (61) in overlying relationship and sewing the narrower mattress pad material at its side edges to the sheet material. The combined work product is then cut to length, the end portions folded over, and the corners bevelled and sewn together. An elastic tape (48, 49) is applied to each end of the work product so as to draw the mattress pad and fitted bed sheet about the mattress. The structure enables the mattress pad and fitted bed sheet to stay in proper position even when applied to a foldable mattress (24) of a sofa bed (20), when the mattress is folded into its hidden position inside the sofa bed.

7 Claims, 3 Drawing Sheets

FIG. 1
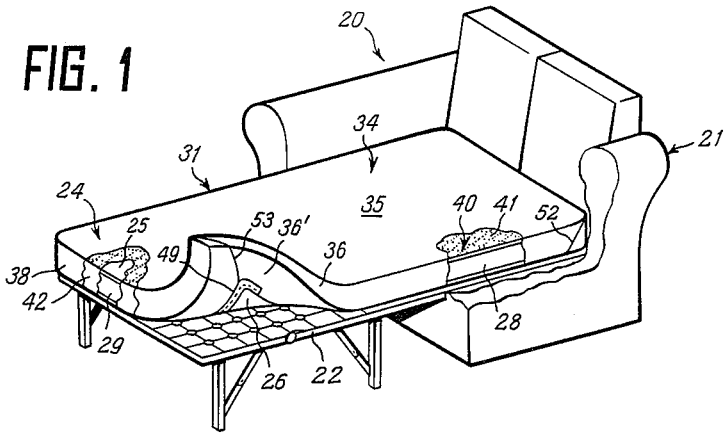
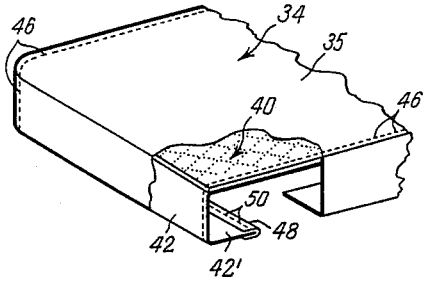
FIG. 3
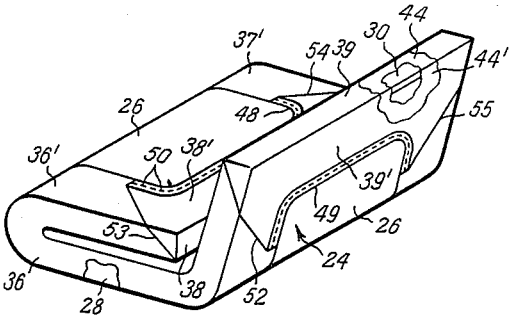
FIG. 2
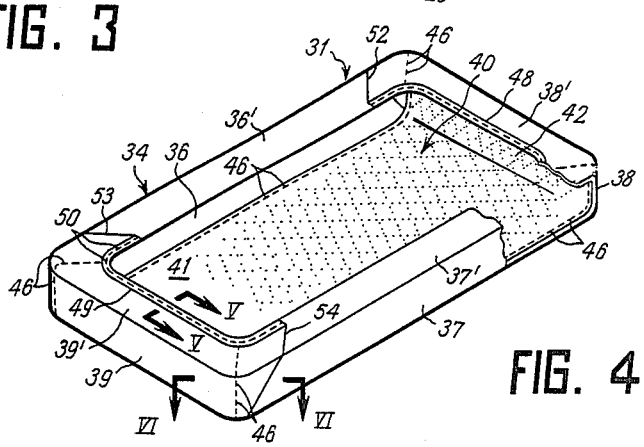
FIG. 4
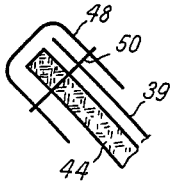
FIG. 5
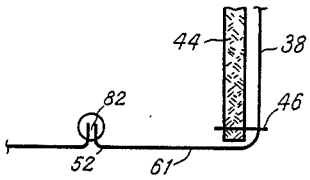
FIG. 6

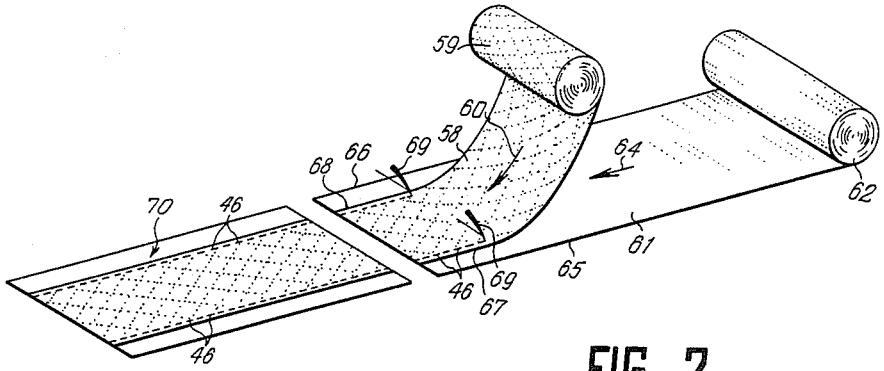
FIG. 7
FIG. 8
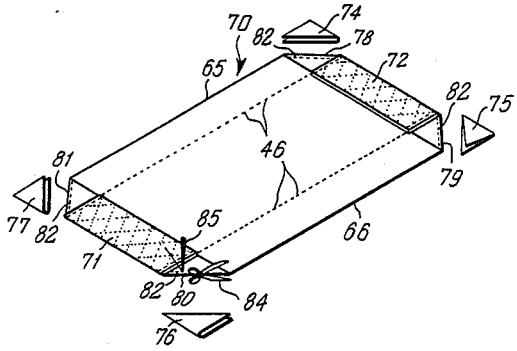
FIG. 9
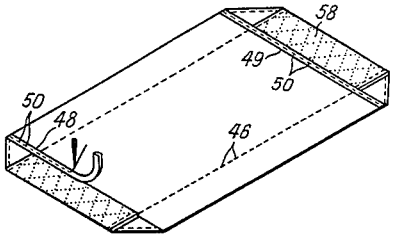
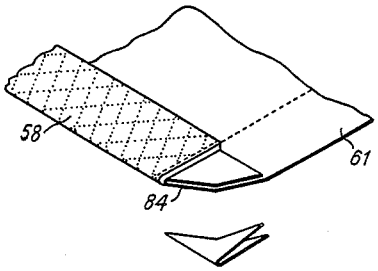
FIG. 10
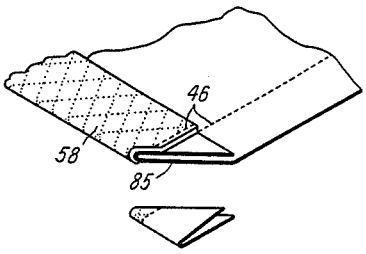
FIG. 11

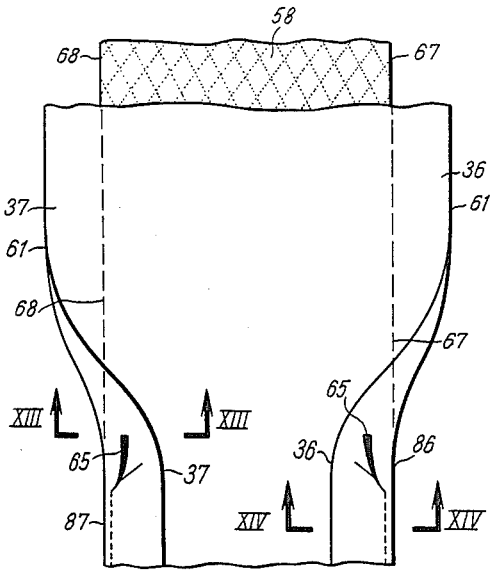
FIG. 12
FIG. 13
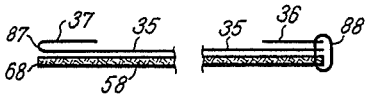
FIG. 14
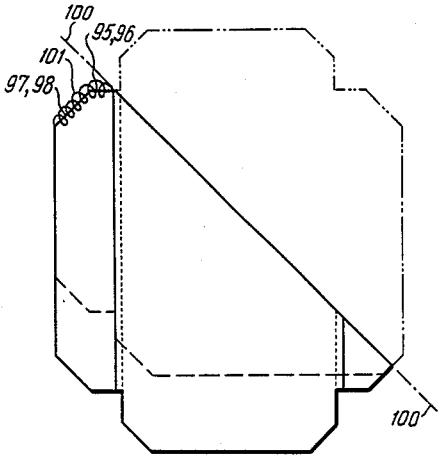
FIG. 16
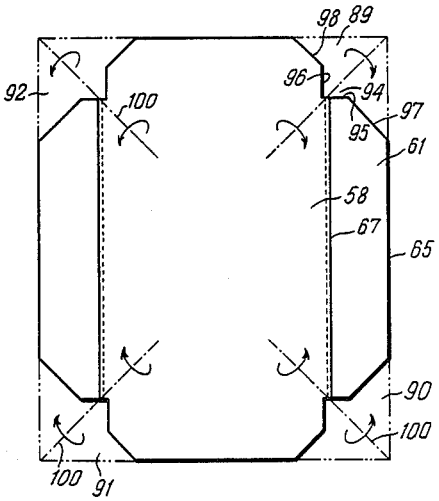
FIG. 15

MATTRESS PAD AND FITTED BED SHEET FOR FOLDABLE SOFA BED MATTRESSES

CROSS REFERENCE TO RELATED APPLICATION

This is a continuation-in-part of U.S. patent application Ser. No. 805,319, now U.S. Pat. No. 4,682,379, filed Dec. 4, 1985.

FIELD OF THE INVENTION

This invention relates to the combination of a fitted bed sheet and mattress pad which are permanently attached to each other and can be fitted to or removed from a relatively unbendable mattress of a bed or a more bendable mattress of a sofa bed or the like, and further relates to processes for manufacturing the fitted bed sheet and mattress pad.

BACKGROUND OF THE INVENTION

Mattress pads have been in common use for placement between the top surface of a mattress and a bed sheet, so as to shield the mattress from becoming soiled and to provide extra comfort to the person sleeping on the bed. Typically, the mattress pads include a skirt or other connection means that fits about the corners of the mattress so as to hold the mattress pad in position on the bed. Then the fitted or "contoured" bottom bed sheet is placed about the mattress over the mattress pad, with its skirt placed about the mattress.

Generally, the manufacturers of sheets do not manufacture mattress pads, and vice versa. Therefore, when a fitted sheet and a mattress pad are put on a bed, the top ply of the pad is likely to be a different size than the top ply of the sheet, which might case wrinkling of the pad or sheet.

The use of separate bed sheets and mattress pads requires the individual production of two separate objects that are used together on a bed. Moreover, the separate construction of the bed sheet and mattress pad sometimes results in the mattress pad becoming wrinkled or displaced from proper position between the sheet and the mattress, which is likely to cause some discomfort to the person sleeping on the bed. This problem is especially prevelant in the case of sofa bed mattresses due to the folding and unfolding of the mattress. Also, as the mattress pad and bed sheet are used and laundered over an extended period, they tend to change shapes, usually with the mattress pad shrinking slightly so that it does not correspond to the shape of the bed sheet or to the shape of the mattress. The mattres pad and bed sheet are purchased separately, put on and removed from the mattress separately, and are stored and laundered separately.

It would be desirable to construct a combination fitted bed sheet and mattress pad in one production process so as to minimize the steps required to make these items, and thereby reduce the cost of production. In addition, it would be desirable to provide a combination fitted bed sheet and mattress pad for a bed mattress or for a foldable sofa bed mattress whereby the mattress pad is permanently connected to the fitted bed sheet and tends to retain a shape that corresponds to the bed sheet, and both the bed sheet and mattress pad can be simultaneously fitted to or removed from the mattress.

Further, it would be desirable to construct a combination bed sheet and mattress pad that would fit the foldable mattress of a sofa bed and which would become stretched longitudinally into a smooth configuration on the mattress top surface when the bed is pulled out from its stored position to its flat or sleep position, thus tending to eliminate any folds and wrinkles in the sheet as well as in the mattress pad which were formed when the bed was in its folded configuration. Also, it would be desirable to construct a combination sheet and mattress pad that will tend to remain in place about a sofabed mattress during the folding and unfolding process.

SUMMARY OF THE INVENTION

Briefly described, the present invention comprises a combined fitted or "contoured" bottom bed sheet and mattress pad which are permanently connected together, and a process of fabricating the combined fitted bed sheet and mattress pad.

In one form of the invention bed sheet material and mattress pad material are advanced along their lengths from separate supplies and moved into overlying relationship and cut to equal lengths, with the narrower mattress pad centered between the side edge portions of the bed sheet. The mattress pad is sewn at its side edges to the bed sheet, with the overlapping side portions of the bed sheet later formed into side skirts and under skirts along opposite sides of the mattress pad that will fit about the mattress. Notches are formed at the corners of the bed sheet, and the head and foot portions of the bed sheet and mattress pad are sewn at the notches to the side skirts of the bed sheet while the head and foot underskirt portions are sewn to the side under skirt portions. An elastic hem is formed about the head and foot underskirt edges of the bed sheet and mattress pad.

The combined fitted bed sheet and mattress pad include in its skirts at both the head and foot of the mattress the end portions of the mattress pad material, with the mattress pad sewn at all four of its edge portions to the bed sheet. This assures permanent connection of the mattress pad to the bed sheet and tends to cause the mattress pad to retain a shape that corresponds to the sleeping surface of the bed sheet. Moreover, should the mattress pad shrink during laundering, the elastic hems at both the head and foot of the bed sheet tend to stretch the mattress pad lengthwise about the mattress. The tension applied by the elastic hem at both the head and foot of the bed sheet tends to apply tension to the lower selvage of the skirt of the bed sheet, which further tends to stretch the bed sheet across the length of the mattress, tending to pull the bed sheet and mattress pad taut, resulting in both a smooth top surface of the bed sheet and a smooth mattress pad beneath the bed sheet. This tension together with a relatively large amount of underskirt material formed on the contoured bed sheet acts to hold the combination bed sheet and mattress pad about a sofa bed mattress when it is folded. The underskirts extend beneath the mattress far enough such that they remain in proper orientation on the mattress during the folding action.

Generally, the combined fitted bed sheet and mattress pad are considered by some people to be more comfortable than the separate pad and sheet, and when the sheet of the combined bed sheet and mattress pad is to be laundered, the mattress pad also must be laundered, resulting in improved hygiene in those situations in which a separate pad might not be laundered when its sheet is laundered.

Thus, it is an object of this invention to provide a combined mattress pad and fitted bed sheet for use on a bed mattress, which is expedient to produce and which is convenient to fit to and remove from a mattress, and which tends to remain in proper orientation about the mattress even when the mattress if folded.

Another object of this invention is to provide a process of making a combined fitted bottom bed sheet and mattress pad which reduces the number of steps required to make a mattress pad and bed sheet and which forms an improved product.

Other objects, features and advantages of this invention will become apparent upon reading the following specification, when taken in conjunction with the accompanying drawings.

BRIEF DESCRIPTION OF THE DRAWINGS

FIG. 1 is perspective illustration of the bed sheet and mattress pad combination, showing the product fitted on an unfolded sofa bed mattress with the mattress resting on the unfolded support of a sofa bed structure, with one corner of the mattress being lifted up to show the underskirt portion of the mattress pad and fitted bed sheet.

FIG. 2 is a perspective illustration of the folded mattress of a sofa bed, with the mattress pad and fitted bed sheet combination applied to the folded mattress.

FIG. 3 is a detail illustration of one end portion of the bed sheet and mattress pad combination, with a portion broken away to illustrate the inner components of the product.

FIG. 4 is an inverted illustration ofthe mattress pad and fitted bed sheet, with portions broken away to illustrate features of the invention.

FIG. 5 is a detail cross-sectional illustration of the elastic hem at one end of the mattress pad and fitted bed sheet, taken along lines 5—5 of FIG. 4.

FIG. 6 is a detail cross-sectional illustration of a portion of the mattress pad and fitted bed sheet, taken along lines 6—6 of FIG. 4.

FIG. 7 is a schematic illustration of the process by which the mattress pad material and the sheet material are fed into overlying relationship with respect to each other, sewn together at the side edges of the mattress pad material, and then cut to length.

FIGS. 8 and 9 are progressive illustrations of the manner in which the mattress pad and fitted bed sheet are formed, with FIG. 8 illustrating how the end portions of the structure are folded over and the corner portions are cut and sewn, and with FIG. 9 illustrating how the elastic tape is sewn to the head and foot underskirts.

FIG. 10 is a detail illustration of a corner cut of a mattress pad and fitted bed sheet, similar to the corner cuts of FIG. 8, but showing a modified cut formation.

FIG. 11 is a detail illustration of a corner cut, similar to FIG. 10, but showing a second modification of the corner cut.

FIG. 12 is a schematic illustration of the process by which the mattress pad material is progressively connected to the bed sheet material, showing an alternate process for connecting the elements.

FIGS. 13 and 14 are progressive illustrations of the side skirts and portions of the top ply and mattress pad material as these elements are being formed, taken along lines 13—13 and 14—14, respectively, of FIG. 12.

FIG. 15 is a layout of the cut mattress pad and cut bed sheet material, showing an alternate form of the invention, at the stage when the mattress pad material has been connected along its side edges to the bed sheet material and the corners of the bed sheet material have been cut but not yet sewn.

FIG. 16 illustrates the mattress pad and bed sheet material of FIG. 15 after the layers of material have been folded so that the notched corners can be sewn.

DETAILED DESCRIPTION

Referring now in more detail to the drawings, in which like numerals indicate like parts throughout the several views, FIG. 1 illustrates a sofa bed 20 that includes a conventional arm rest and back structure 21 and a foldable mattress support 22 which is movable from the illustrated flat configuration into a folded configuration whereby the support folds into and substantially disappears into the arm rest and back structure 21. This is conventional in the art.

Sofa bed 20 also includes a foldable mattress 24 that is supported by the mattress support 22 of the sofa bed. In general, foldable mattress 24 includes a top surface 25, bottom surface 26, parallel, vertical opposed side surfaces 28, vertical foot surface 29 and vertical head surface 30.

As illustrated in FIG. 2, the mattress is relatively thin and is foldable across its length so that the mattress can be folded into and become hidden by the arm rest and back structure 21. Additional cushions (not shown) are placed upon the mattress after it has been folded into the arm rest and back structure, which is conventional in the art.

As illustrated in FIG. 1, the mattress pad and fitted bed sheet combination 31 is fitted about and covers the top surface 25 and the side surfaces 28–30 of the foldable mattress 24, and the mattress pad and fitted bed sheet combination also extends partially beneath the mattress. The mattress pad and fitted bed sheet includes a fitted bed sheet 34 that includes top ply 35 of a size and shape substantially the same as the size and shape of the top surface 25 of the mattress, opposed vertical side skirts 36 and 37, foot skirt 38 and head skirt 39. The vertical side skirts, the vertical foot and head skirts are of a width substantially greater than the vertical sides of the mattress and extend on beneath the mattress to form underskirts 36', 37', 38' and 39'.

The mattress pad material comprises a fiber filled pad material with its bottom layer including a woven sheet and its top layer which faces the top ply of the fitted bed sheet comprising nonwoven fiber fill. Mattress pad 40 is positioned in underlying relationship with respect to fitted bed sheet 31 and includes top ply 41 which is of a size and shape substantially the same as the top ply 35 of the bed sheet and includes foot and head shirts 42 and 44 which extend in underlying relationship with respect to the foot and head skirts 38 and 39 of the bed sheet, with the foot and head skirts 42 and 44 extending on beneath the mattress at the foot and head of the mattress, into the underskirts 38' and 39' of the bed sheet.

As illustrated in FIG. 3, the general arrangement of the mattress pad and fitted bed sheet combination is that mattress pad 40 is of a width which is substantially the same as the width of the top ply 35 of the fitted bed sheet 34, but is of a length longer than the top ply of the bed sheet such that the foot and head portions of the mattress pad turn downwardly to form foot and head skirts 42 and 44, with the foot and head skirts extending further beneath the mattress to form underskirts 42' and 44'.

Stitching 46 is formed along the side edges of the mattress pad and connects to the side edges of the mattress pad to the fitted bed sheet. Stretched elastic hems 48 and 49 are folded about the aligned edges of the mattress pad material and bed sheet material at the foot and head edges of the mattress pad and fitted bed sheet combination and are sewn into place by stitching 50. The elastic bands 48 and 49 apply tension to the inner edges of the underskirts 36'–39' of the fitted bed sheet and to the underskirts 42' and 44' of the mattress pad. This tends to hold the underskirts in position on the mattress pad. Further, the absence of side skirts of the mattress pad material tends to eliminate any tendency of the mattress pad to pull away from the side surfaces of the mattress when the mattress is in its folded configuration (FIG. 2).

The side skirts and foot and head skirts of the fitted bed sheet and the foot and head skirts of the mattress pad are sewn together at the corners of the structure, as illustrated by seams 52, 53, 54 and 55 (FIGS. 2 and 4).

As illustrated in FIG. 7, the mattress pad and fitted bed sheet 34 is produced by moving a supply of mattress pad material 58 from a supply such as from reel 59 along the length of the mattress pad material in the direction as indicated by arrow 60 into overlying relationship with the length of sheet material 61 which is moved from its supply 62 in a similar direction as indicated by arrow 64. The mattress pad material 58 is narrower than the bed sheet material 62, and the mattress pad material is centered intermediate the side edges 65 and 66 of the sheet material. When the layers of material have moved into overlying relationship, the mattress pad material is sewn along its side edge portions 67 and 68 to the sheet material as schematically indicated by sewing machine needles 69 which form the continuous lock stitches 46. The combined sheets of material 70 are then cut to length.

As illustrated in FIG. 8, the cut end portions 71 and 72 which later form the foot and head skirts and underskirts of the finished product are then folded back into overlying relationship with the intermediate portion of the combined sheets 70. The corners 74, 75, 76 and 77 of the folded over portions of the combined sheets are cut away from the main body of the combined sheets, forming bevelled edges 78, 79, 80 and 81. The matched bevelled edges 78–81 are then sewn with an overedge stitch 82 (FIGS. 6 and 8). This is schematically indicated by the scissors 84 and the sewing needle 85 in FIG. 8. However, the cutting and sewing operaton is performed by a conventional overedge sewing machine that includes a cutting mechanism that cuts just ahead of the sewing needle.

As illustrated in FIGS. 5 and 9, after the bevelled corners of the structure have been formed, the elastic bands 48 and 49 are applied to the aligned end edges of the sheet material and mattress pad material. The elastic bands are folded about the aligned edges of the sheet material and mattress pad material, and as the elastic bands are applied to the sheet structure the bands are stretched and then sewn about the aligned edges of the sheet and pad material with the stitching 50. It will be noted that the stretched bands 48 and 49 are of a length greater than the width of the mattress pad material 58, so that the elastic bands extend on beyond the mattress pad material and about an edge portion of the sheet material. After the elastic bands have been sewn to the sheet and mattress pad material, and have been allowed to contract, the mattress pad and sheet material will be shired or gathered.

The steps of beveling and sewing the corners of the mattress pad and fitted bed sheet simplifies the process of forming the mattress pad and fitted bed sheet. Further, the relatively thick mattress pad material does not have to be cut during the beveling and sewing process at the corners of the structure. Also, when the elastic hems 48 and 49 are applied to the structure, the structure is shaped so that the hems can be applied in substantially a straight line across the work product, substantially without requiring the sewing machine operator to twist or turn the work product in the sewing machine.

As illustrated in FIGS. 10 and 11, the bevelled cut across the corners of the mattress pad and fitted bed sheet can be varied, if desired. FIG. 10 illustrates a bevel cut 84 that starts at a 45° angle from the mattress pad material 58 and then turns to a greater angle, more than 45°. This removes some of the material that will form the underskirt of the final product, making the underskirt fit together on the mattress. FIG. 11 illustrates a bevel cut 85 that extends into the mattress pad material 58. While it is desirable not to cut the mattress pad material so as to avoid having to cut the thicker material of the work product, this particular cut forms the corner of the pad/sheet with a more rounded shape that conforms better to the typical rounded corner of a mattress.

Although FIG. 7 illustrates the mattress pad material being sewn along its side edges with a conventional lock stitch to the bed sheet material, FIGS. 12–14 illustrate another method of sewing the mattress pad at its side edges to the bed sheet. The bed sheet material 61 is moved into overlying relationship with respect to the mattress pad material 58 and the side edge portions of the bed sheet material which eventually becomes the side skirts and underskirt 36 and 37 are folded over into overlying relationship with respect to the intermediate portion of the bed sheet material, with the fold lines 86 and 87 substantially aligned with the side edges 67 and 68 of the mattress pad (FIG. 13). The aligned edges are trimmed with a conventional overedge sewing machine with a cutter mechanism (not shown), and an overedge stitch 88 is formed at the cut aligned edges (FIG. 14). With this construction, when the vertical side skirts 36 and 37 are folded to a vertical attitude and draped downwardly from the top ply 35 of the fitted bed sheet, a nest seam appearance will be visible at the side edges of the mattress.

As illustrated in FIGS. 15 and 16, another type of corner cut can be made in the mattress pad material and bed sheet material, if desired. After the mattress pad material 58 has been sewn at its edges 67 and 68 to the bed sheet material 61, the corners 89, 90, 91 and 92 of the work product can be removed by saw cutting or die cutting several layers of the work product simultaneously. The corner cut at each corner of the work product will comprise a 90° notch 94 that has side edges 95 and 96 that extend across and longitudinally with respect to the length of the work product, respectively, and 45° bevelled edges 97 and 98 that intersect the side edges 65 and 66 of the sheet material.

After the corner cuts have been made as illustrated in FIG. 15, the work product is then folded at each corner to sew each corner structure. Each corner is folded about an axis 100 which bisects the 90° notch 94, so that the side edges 95 and 96 of the 90° notch become aligned with each other and the bevelled edges 97 and 98 become aligned with each other. These edges are sewn together, as with an overedge stitch 101 as illustrated in FIG. 16. Also, the aligned edges can be attached by sewing an elastic band material about the aligned edges and sewing through the layers of material, as generally shown by the band 48 of FIG. 5. The elastic bands 48 and 49 are then applied to the inner edges of the underskirt portion of the work product. With this construction, the work product will look substantially as illustrated in FIG. 4, except that the corner seams will be located at the corners of the work product instead of being offset along the side edges of the work product.

While the invention has been described as utilizing a fiber fill mattress pad material as the mattress pad, it should be obvious to those skilled in the art that the mattress pad material can comprise other materials, including foam rubber sheet material, sliver knit, rubber sheet material or other waterproof sheet material. Moreover, the mattress pad can be formed with a metalized layer as a part of the fiber fill or other sheet layer so as to form a heat reflective surface within the mattress pad, for the purpose of reflecting body heat and heat from other sources. Moreover, it is within the purview of this invention to form the mattress pad material of a width equal to the width of the entire bed sheet material, so that the side skirts of the pad sheet include both sheet material and pad material.

Although FIG. 7 illustrates the mattress pad material and sheet material being progressively moved into overlying relationship and sewn together at the sides of the mattress pad material and then cut, another process for forming the pad-sheet is to progressively form the bevelled corners of the structure during the cut-to-length procedure, as by folding over the previously cut leading edge of the work product and then bevel cut and sewing the corners of the leading edge of the work product, then advancing the work product to a cut station where the product is cut to length, and then bevel cut and sewing the third and fourth corners of the work product.

While the mattress pad material 58 of FIG. 7 is illustrated as being sewn directly to the sheet material, this leaves a relatively raw edge at the sides of the mattress pad material. In order to avoid the presence of raw side edges of the mattress pad material in the finished product, the mattress pad material can be taken directly from its supply and an overedge stitch or binding formed at its side edges, or other edge treatment can be performed on the side edges of the mattress pad material. For example, an adhesive, tape or other edge treatments can be applied to the mattress pad material before the mattress pad material is sewn at its side edges to the sheet material. Although the elastic hems 48 and 49 have been disclosed as elastic band material, such as Lycra, folded over the matched edges of the pad and sheet, other hem structures can be formed, such as folding the sheet about the edge of the pad and sewing a flat band to the fold.

It should be understood that the just described embodiments of the invention merely illustrate principles of the invention in preferred forms. Other modifications and variations may be made thereto without departure from the spirit and scope of the invention as set forth in the following claims.

I claim:

1. A fitted bed sheet and mattress pad combination for foldable mattresses of the type used of sofa beds and the like comprising;

a bed sheet with an approximately rectangular top ply for mounting in overlying arrangement over one surface of an approximately rectangular mattress, foot, head and opposite side skirts extending from the foot, head and opposite side edge portions of said top ply for fitting about the side surfaces of the mattress,and under skirts extending from the foot, head and opposite side skirts, the underskirts being of a width so as to extend beneath the mattress a distance sufficient to hold the sheet on the mattress when the mattress is folded, a mattress pad in underlying relationship with respect to the top ply of said bed sheet, said mattress pad being of a width approximately the same as the width of the top ply of said bed sheet and of a length longer than the length of the top ply of said bed sheet and extending beyond the top ply of said bed sheet into underlying relationship with the foot and head skirts of said bed sheet and further extending into underlying relationship with the underskirts extending from said foot and head skirts, first connecting means holding together said bed sheet and said mattress pad adjacent the opposite side edges of said mattress pad and at the opposite side edge portions of the top ply of said bed sheet, and second connecting means holding together the under skirt portions of said bed sheet and the underskirt portions of said mattress pad.

2. The fitted bed sheet and mattress pad combination of claim 1 and wherein said first connecting means comprises lock stitching.

3. The fitted bed sheet and mattress pad combination of claim 1 and wherein said second connecting means comprises an elastic strip sewn to the underskirt portions of the mattress pad and the under skirt portions of said bed sheet extending from the head and foot skirts of said bed sheet.

4. The fitted bed sheet and mattress pad combination of claim 1 and wherein said first connecting means comprises overedge stitching.

5. The fitted bed sheet and mattress pad combination of claim 1 and wherein said mattress pad is formed of a material selected from a group of materials consisting of fiber-fill material, liquid impervious sheet material, heat reflective material, foam rubber, sliver knit, fleece, and pile fabric.

6. In combination, a sofa bed having a foldable mattress support, a substantially rectangular foldable mattress positioned on the foldable mattress support of said sofa bed, said mattress having a top surface, a bottom surface, opposed vertical side surfaces, a vertical head surface and a vertical foot surface, a mattress pad positioned on top surface of said mattress, a contoured sheet positioned over the mattress pad and including a top ply positioned over the top surface of said mattress and opposed side skirts and opposed head and foot skirts extending about the side, head and foot surfaces of said mattress and partially beneath said mattress, and stitching means connecting said mattress pad along its side edges to the top ply of said contoured sheet, said mattress pad being of a width substantially the same as the width of the top surface of said mattress and of a length longer than the length of the top surface of said mattress and extending into the head and foot skirts of said fitted sheet.

7. The combination mattress, sheet and mattress pad of claim 6 and further including elastic strips attached to the head and foot skirts of said contoured sheet, said elastic strips tending to gather the sheet and therefore hold the contoured sheet and mattress pad in place about the mattress.

* * * * *